US008939670B2

(12) United States Patent
Choi

(10) Patent No.: US 8,939,670 B2
(45) Date of Patent: Jan. 27, 2015

(54) ROTATION ON/OFF-TYPE BRUSH-TUBE-SHAPED COSMETIC CONTAINER

(75) Inventor: Seong-Woong Choi, Incheon (KR)

(73) Assignee: Yonwoo Co., Ltd., Incheon (KR)

( * ) Notice: Subject to any disclaimer, the term of this patent is extended or adjusted under 35 U.S.C. 154(b) by 117 days.

(21) Appl. No.: 13/817,434

(22) PCT Filed: Sep. 19, 2011

(86) PCT No.: PCT/KR2011/006903

§ 371 (c)(1),
(2), (4) Date: Feb. 15, 2013

(87) PCT Pub. No.: WO2012/036531

PCT Pub. Date: Mar. 22, 2012

(65) Prior Publication Data

US 2013/0189018 A1 Jul. 25, 2013

(30) Foreign Application Priority Data

Sep. 17, 2010 (KR) ..... 10-2010-0091726

(51) Int. Cl.

| | |
|---|---|
| ***A46B 11/02*** | (2006.01) |
| ***A45D 40/26*** | (2006.01) |
| ***A45D 34/04*** | (2006.01) |
| ***A46B 11/00*** | (2006.01) |

(52) U.S. Cl.

CPC ..... *A45D 40/262* (2013.01); *A45D 34/042* (2013.01); *A46B 11/00* (2013.01); *A46B 11/0086* (2013.01); *A46B 11/002* (2013.01); *A46B 11/0079* (2013.01); *A46B 11/0089* (2013.01); *A46B 11/0048* (2013.01); *A45D 2200/051* (2013.01); *A46B 2200/1046* (2013.01)

USPC ..... 401/281; 222/554; 401/205

(58) Field of Classification Search

CPC ..... A46B 11/0048; A46B 11/0079; A46B 11/0086

USPC ..... 401/205, 270, 280, 281; 222/549, 550, 222/552, 554

See application file for complete search history.

(56) References Cited

U.S. PATENT DOCUMENTS

| | | | | |
|---|---|---|---|---|
| 7,101,105 | B2 * | 9/2006 | Reggiani | 401/205 |
| 7,261,226 | B2 * | 8/2007 | Adams et al. | 222/521 |
| 7,287,927 | B2 * | 10/2007 | Zhang | 401/278 |
| 7,461,988 | B2 * | 12/2008 | Albisetti | 401/116 |

FOREIGN PATENT DOCUMENTS

| | | | |
|---|---|---|---|
| JP | 2001-96218 | A | 4/2001 |
| JP | 2004-180965 | A | 7/2004 |
| KR | 10-0867684 | B1 | 11/2008 |
| KR | 10-2009-0028277 | A | 3/2009 |
| KR | 10-1192211 | B1 | 10/2012 |

OTHER PUBLICATIONS

International Search Report for PCT/KR2011/006903 filed on Sep. 19, 2011.

* cited by examiner

*Primary Examiner* — David Walczak
*Assistant Examiner* — Joshua Wiljanen

(57) ABSTRACT

The present invention relates to a rotation on/off-type brush-tube-shaped cosmetic container, having following advantages: only with the action of turning a rotation cap, a cosmetic container may be simply opened/closed, resulting in discharging the cosmetics; though a tube container is accidentally pressurized while being used or while in storage, it still can prevent the cosmetics from being leaked. In addition, by means of the shape of a screw-type spiral groove, a seal cap and a rotation cap can be firmly fixed at the maximum rising/descending position, and can be carried out in a smooth manner during rising/descending movement.

4 Claims, 6 Drawing Sheets

[Fig. 1]
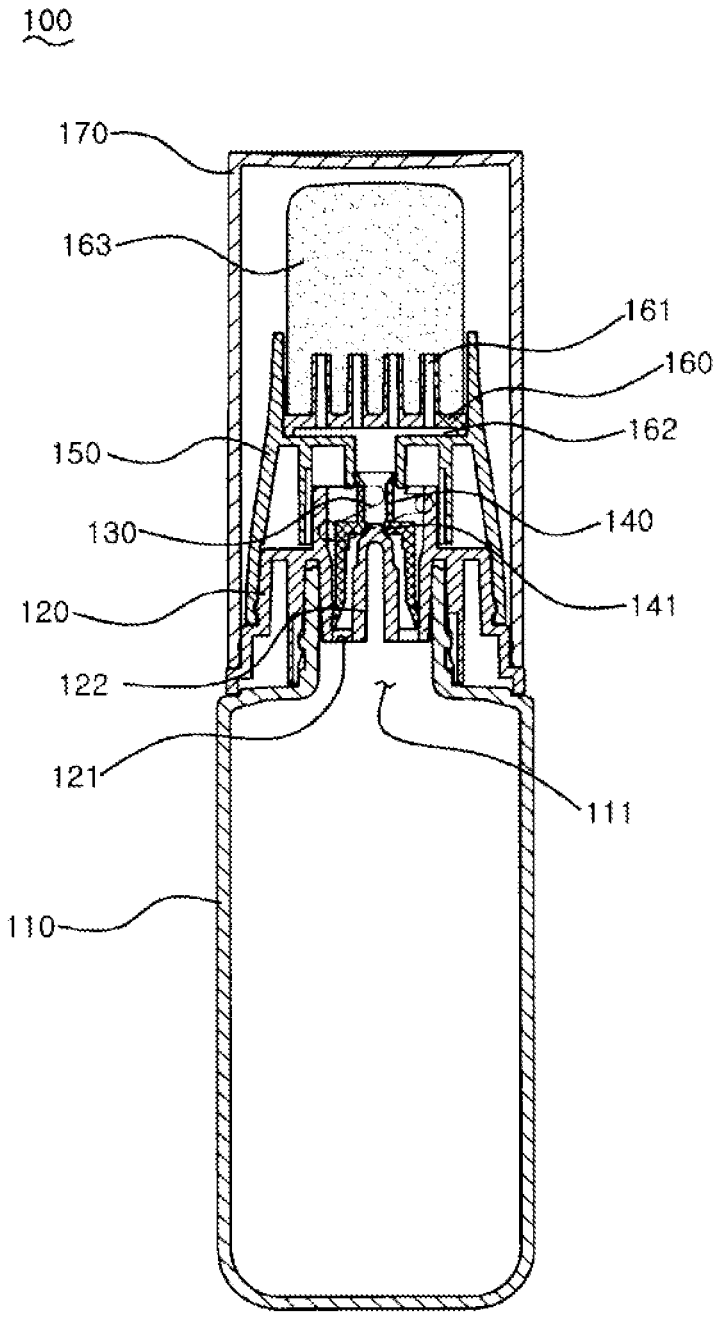

[Fig. 2]
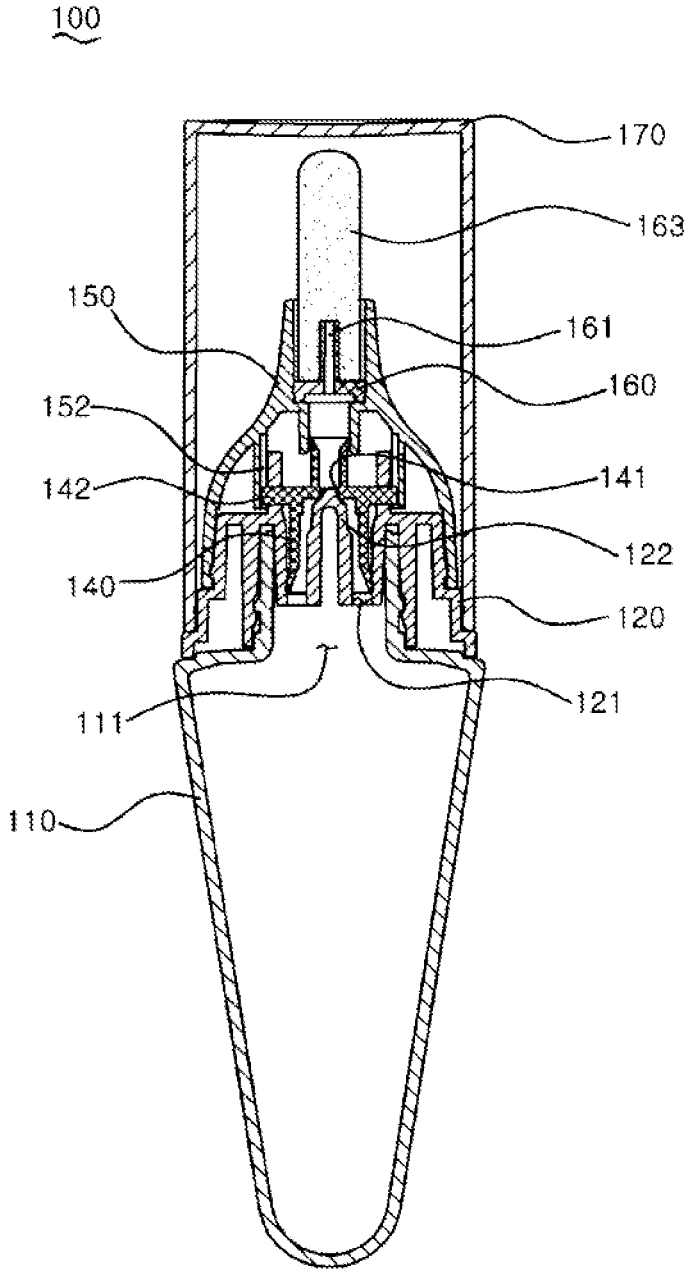

[Fig. 3]
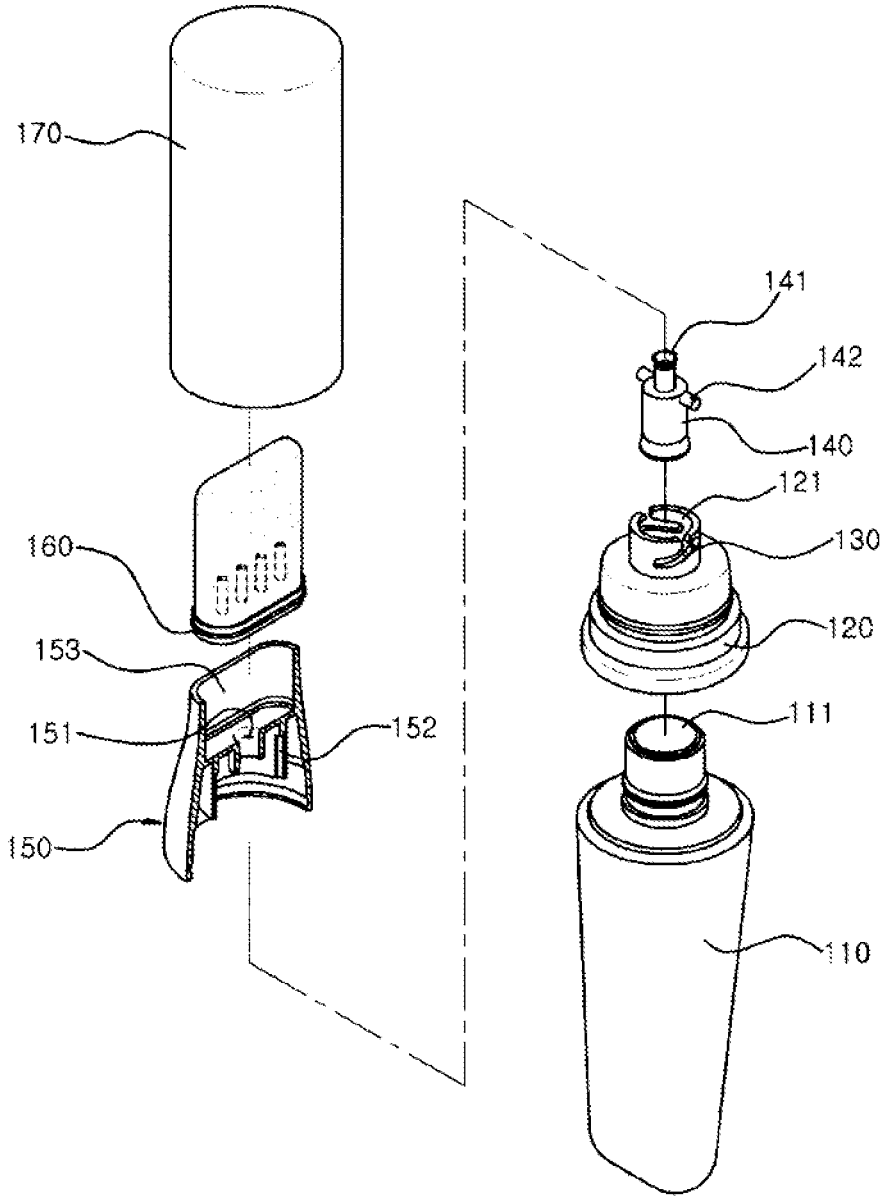

[Fig. 4]
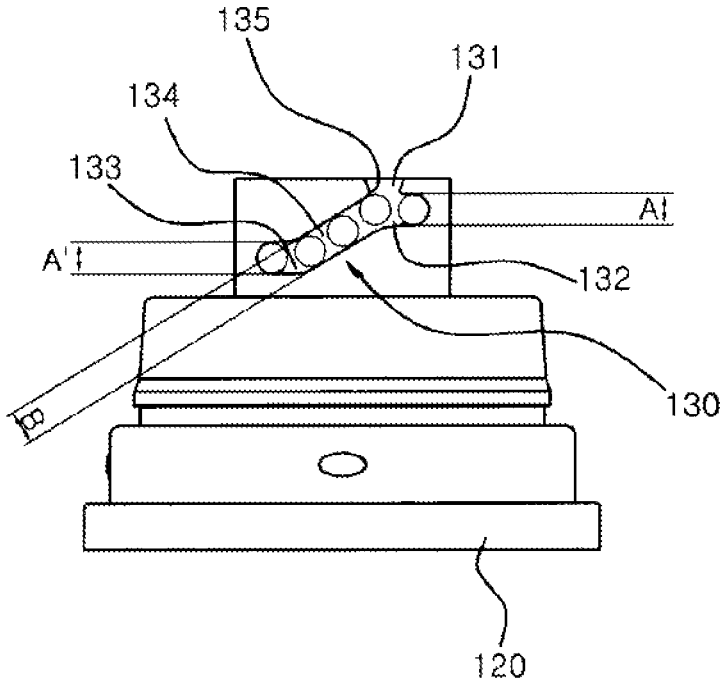

[Fig. 5]
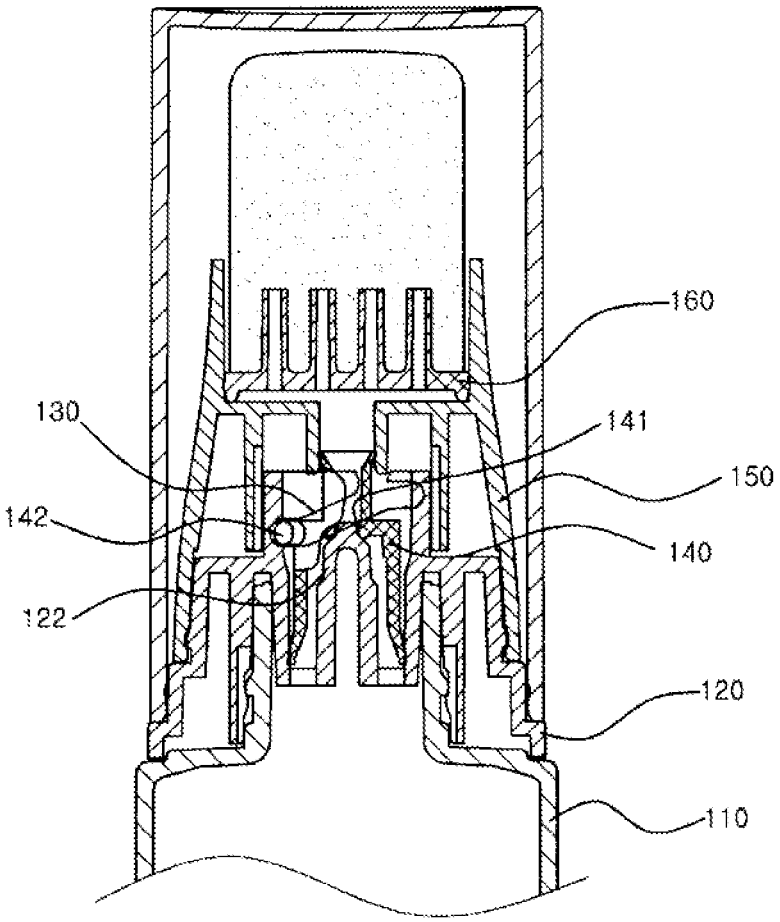

[Fig. 6]
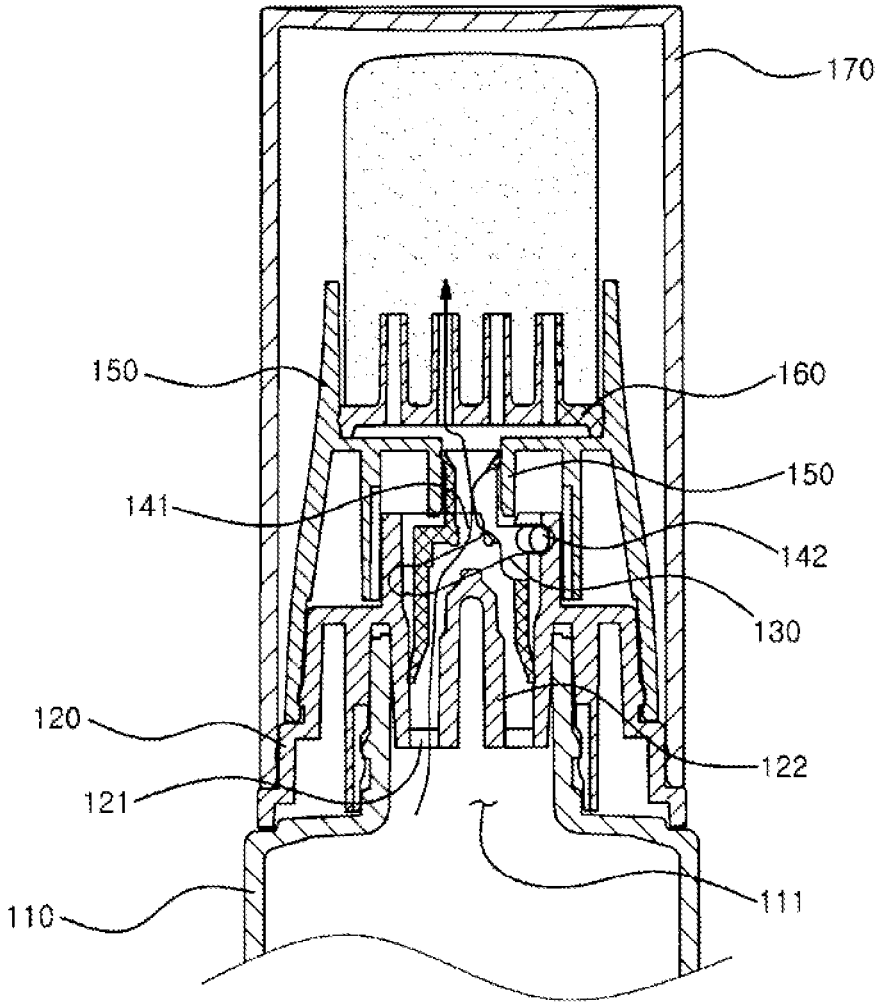

ROTATION ON/OFF-TYPE BRUSH-TUBE-SHAPED COSMETIC CONTAINER

TECHNICAL FIELD OF THE INVENTION

The invention relates to a rotation on/off-type brush-tube-shaped cosmetic container 100. It is a tube-type cosmetic container 110 formed through the tube container 110 which is pressurized to discharge the cosmetics out of a discharge hole 111. It comprises: a fixation body 120 inserted into the front end of the tube container 110, with the central portion of the fixation body 120 formed with a protruding portion for closing 122, the lower part of the protruding portion for closing 122 forming a hole 121, and the two sides of the outer periphery of the upper part of the protruding portion respectively forming a screw-type spiral groove 130 from the upper end to the central part; a sealing cap 140 formed with a communication hole 141, with the central part of the communication hole 141.

communicated to discharge the cosmetic, the protruding portion for closing 122 inserted into the communication hole 141 when descending from the lower part so that the communication hole 141 is closed, and the outer peripheral surface of the seal cap formed with a combined protuberance 142 which is combined with the screw-type spiral groove 130 in a manner of being inserted into the screw-type spiral groove 130; a rotation cap 150 crossly formed with an access groove 151 at the upper end thereof, which provides an access for the seal cap 140, with the inner part of the rotation cap 150 formed with a vertical guide groove 152 combined with the combined protuberance 142, the upper part of the rotation cap 150 forming a brush nozzle mounting portion 153, and the rotation cap 150 combined with the outer peripheral surface of the fixation body 120 and facilitating the seal cap 140 to be lift/descended with the rotation movement; a brush nozzle 160 inserted into the brush nozzle mounting portion 153, fixed, and formed with more than one nozzle inserted into a brush 163.

TECHNICAL BACKGROUND OF THE INVENTION

A cosmetic container generally accommodates toner, lotion and eye cream. In particular, gel-type cosmetics, such as lotion, cream and so on, widely uses a tube-type cosmetic container which is easy to be used and has a low manufacturing cost. As to the existing cosmetic containers, in order that gel type cosmetics may be more easily applied, a brush, mostly made of porous elastic materials such as sponge and so on, is attached to a discharge outlet.

However, as to such existing tube-type cosmetic containers attached by the brush, when they are not properly opened, the tube containers may be accidentally pressurized and the leakage of cosmetics may occur while being used or while in storage.

SUMMARY OF THE INVENTION

Technical Problems

Through solving the above problems in the prior art, in the present invention, a rotation on/off-type brush-tube-type cosmetic container, a rotation cap is simply rotated and then the opening/closing can be simply implemented to discharge the cosmetic, so that a tube container, though accidentally pressurized, still may prevent cosmetics from being leaked while being used or in storage.

Moreover, the objective of the invention is that the shape of a screw-shape screw-type spiral groove which has an effective function, enable a seal cap and a rotation cap to be firmly fixed at the maximum rising/descending position, and a rising/descending action to be moved in the smooth manner.

SOLUTIONS FOR THE PROBLEMS

To solve the above problems, the invention, a rotation on/off-type brush-tube-type cosmetic container features a tube-type cosmetic container 110 which is pressurized to discharge the cosmetics through a discharge hole 111, comprising: a fixation body 120 inserted into the front end of the tube container 110, wherein the central portion of the fixation body 120 is formed with a protruding portion for closing 122, the lower portion of the protruding portion for closing 122 is formed a discharge hole 121, and the two sides of the outer periphery of the upper part of the protruding portion respectively form a screw-type spiral groove 130 from the upper end to the central part; a sealing cap 140 formed with a communication hole 141, wherein the central part of the communication hole 141 is communicated to discharge the cosmetics, the protruding portion for closing 122 is inserted into the communication hole 141 when descending from the lower part, so that the communication hole 141 is closed, and the outer peripheral surface of the seal cap is formed with a combined protuberance 142 which is combined with the spiral groove 130 in a manner of being inserted into the spiral groove 130; a rotation cap 150 crossly formed with an access groove 151 at the upper end thereof, which provides an access for the seal cap 140, wherein the inner part of the rotation cap 150 is formed with a vertical guide groove 152 combined with the combined protuberance 142, the upper part of the rotation cap 150 is forming a brush nozzle mounting portion 153, and the rotation cap 150 is combined with the outer peripheral surface of the fixation body 120 so as to be rotated and facilitating the seal cap 140 to rise/descended with the rotation movement; a brush nozzle 160 inserted into the brush nozzle mounting portion 153, fixed, and formed with more than one nozzle inserted into a brush 163; and an over cap 170 which can be attached/detached to the fixation body 120.

Furthermore, the invention is characterized in that the spiral groove 130 comprises: an inserting groove 131 inserted into the combined protuberances 142 to be combined; an upper horizontal groove 132 facilitating the combined protuberance 142 to be engaged at the maximum rising position, and forming a space of which the perimeter is equal to or less than that of the combined protuberance 142, so that the combined protuberance 142 is embedded into the space; a lower horizontal groove 133 facilitating the combined protuberance 142 to be combined at the maximum descending position, and forming a space of which the perimeter is equal to or less than that of the combined protuberance 142, so that the combined protuberance 142 is embedded into the space; an inclination groove 134 forming a space, a gap with the combined protuberance 142, to guarantee not to interfere the movement when the combined protuberance 142 rises/descends; and a bending portion 135, wherein a round-shaped curved surface is formed from the upper horizontal groove 132 toward the inclination groove 134 at the position where the combined protuberance 142 starts to descend.

Meanwhile, the invention is characterized in that the lower part of the brush nozzle (160) is also formed with a space portion 162 which interconnects a plurality of the nozzles 161.

THE EFFECTS OF THE INVENTION

The invention has advantages in that only by turning a rotation cap, the cosmetic container may be opened/closed to discharge the cosmetics with ease, and in case a tube container is accidentally pressurized while using or in storage, it can be prevented the cosmetics from being leaked;

Moreover, the invention has advantages in that with the shape of a screw-type spiral groove, a seal cap and a rotation cap can be firmly fixed at the maximum rising/descending position, and the rising/descending action can be implemented in a smooth manner.

DRAWINGS OF THE INVENTION

FIG. 1 is a perspective view of a rotation on/off-type brush-tube-type cosmetic container according to the invention.

FIG. 2 is a cross-sectional view of a rotation on/off-type brush-tube-type cosmetic container according to the invention.

FIG. 3 is an exploded perspective view of a rotation on/off-type brush-tube-type cosmetic container according to the invention.

FIG. 4 is a detailed diagram of a screw-type spiral groove of a rotation on/off-type brush-tube-type cosmetic container according to the invention.

FIG. 5 is a cross-sectional view of main parts when a rotation on/off-type brush-tube-type cosmetic container is closed according to the invention.

FIG. 6 is a cross-sectional view of main parts when a rotation on/off-type brush-tube-type cosmetic container is opened according to the invention.

EMBODIMENTS OF THE INVENTION

Thereinafter, referring to the drawings, a rotation on/off-type brush-tube-shaped cosmetic container will be described in details. Firstly, it shall be noted that, in the drawings, the same structural parts or elements shall be indicated by the same number as possible. As to the description of the invention, in order to prevent the scope and spirit of the invention from becoming unclear, the detailed specification of the related known functions or structures will be omitted.

As shown in FIGS. 1 and 3, the rotation on/off-type brush-tube-shaped cosmetic container of the invention comprises a container 110, a fixation body 120, a seal cap 140, a rotation cap 150 and a brush nozzle 160.

As shown in FIG. 1, an inner part of a tube container 100 is reserved and stored with cosmetics. Although the tube container 110 can be made of a variety of materials; preferably, it is generally made of synthetic resin. As shown in FIG. 1, the upper end of the tube container 110 is formed with an outlet 111. When a user presses the tube container 110, cosmetics are discharged through the outlet 111.

Furthermore a fixation body 120 will be described. As shown in FIG. 1, the fixation body 120 is sandwiched into the front end of the tube container 110 and forms a protruding portion for closing122 at the central part. As shown in FIG. 1, the lower part of the protruding portion for closing 122 is formed with a hole 121, so that the cosmetics are discharged through the outlet 111. As shown in FIGS. 1 and 3, two sides of the outer periphery of the upper part of the fixation body 120 respectively form a screw-type spiral groove 130 from the upper end to the central part and are combined with a combined protuberance 142 which will be described below.

On the other hand, as shown in FIG. 4, when a rotation on/off-type brush-tube-type cosmetic container 100 is assembled, the a screw-type spiral groove 130 preferably comprises: an inserting groove 131 inserted into the combined protuberances 142 to be combined; an upper horizontal groove 132 facilitating the combined protuberance 142 to be combined at the maximum rising position and forming a space of which the perimeter is equal to or less than that of the combined protuberance 142, so that the combined protuberance 142 is embedded into the space; a lower horizontal groove 133 facilitating the combined protuberance 142 to be combined at the maximum descending position and forming a space of which the perimeter is equal to or less than that of the combined protuberance 142, so that the combined protuberance 142 is embedded into the space; an inclination groove 134 forming a space having a gap with the combined protuberance 142, in order to guarantee not to interfere the movement when the combined protuberance 142 rises/descends; and a bending portion 135 having a round-shaped curved surface at the position where the combined protuberance 142 starts to descend in order that the combined protuberance 142 can enter from the upper horizontal groove 132 toward the inclination groove 134.

Furthermore, a seal cap 140 is described. As shown FIGS. 1 and 6, the seal cap 140 may facilitate the central part to be communicated and discharge the cosmetic outwards when the seal cap 140 is opened. As shown in FIG. 5, the seal cap 140 is formed with a communication hole 141. When the seal cap 140 descends, the protruding portion for closing 122 is inserted from the lower part, thus facilitating the communication hole 141 to be closed. Moreover, as shown in FIGS. 1 and 3, the outer peripheral surface of the seal cap 140 is formed with a combined protuberance 142. The combined protuberance 142 is inserted into the spiral groove 130 to be combined with the screw-type spiral groove 130.

Furthermore, a rotation cap 150 is described. As shown in FIGS. 1 and 3, the rotation cap 150 is crossly formed with an access groove 151 at the upper end thereof, which provides an access for the seal cap 140. The inner part of the rotation cap 150 is formed with a vertical guide groove 152 combined with the combined protuberance 142. The upper part of the rotation cap 150 is formed with a brush nozzle mounting portion 153. As shown in FIGS. 1 and 3, the rotation cap 150 is combined with the outer peripheral surface of the fixation body 120 to be able to be rotated, and with the rotation movement, the combined protuberance 142 combined with the vertical guide groove 152 is linked to be moved; therefore, moving along the screw-type spiral groove 130, the seal cap 140 may be facilitated to rise and descend accordingly.

Furthermore, a brush nozzle 160 is described. As shown in FIGS. 1 and 3, the brush nozzle 160 is inserted into the brush nozzle mounting portion 153, fixed, and formed with more than one nozzle 161 inserted into a brush 163. On the other hand, as shown in FIG. 1, it is preferred that the lower part of the brush nozzle 160 also forms a space portion 162 interconnected with a plurality of the nozzles 161, so that the cosmetics are discharged more smoothly and effectively.

On the other hand, as shown in FIGS. 1 and 3, the rotation on/off-type brush-tube-shaped cosmetic container 100 also comprises an over cap 170 attached to the fixation body 120 so as to be assembled and dissembled.

Hereinbefore, some preferred embodiments are disclosed in the drawings and the description. Here, although specified terms are used, they are only used for describing the objective of the invention but not for limiting the definition or the scope of the invention written in the claims. Accordingly, those skilled in the art shall understand that various modifications and other equivalent examples can be implemented according to the above examples. Therefore, the technical scope, required to be protected in the invention, shall depend on the technical thoughts of claims attached.

The invention claimed is:

1. A rotation on/off-type brush-tube-shaped cosmetic container, wherein a tube container is pressurized so that cosmetics are discharged through an outlet, comprising:

a fixation body inserted into a front end of the tube container, wherein a central part of the fixation body is formed with a protruding portion for closing, a lower part of the protruding portion for closing forms a hole, and two sides of the outer periphery of an upper part of the protruding portion respectively form a screw-type spiral groove from an upper end to the central part;

a seal cap formed with a communication hole, wherein a central part of the communication hole is communicated to discharge the cosmetics, the protruding portion for closing is inserted into the communication hole when the seal cap descends from the lower part, so that the communication hole is closed, and the outer peripheral surface of the seal cap is formed with a combined protuberance which is combined with the screw-type spiral groove in a manner of being inserted into the screw-type spiral groove;

a rotation cap crossly formed with an access groove at an upper end thereof, which provides an access for the seal cap, wherein an inner part of the rotation cap is formed with a vertical guide groove combined with the combined protuberance, an upper part of the rotation cap is formed with a brush nozzle mounting portion, and the rotation cap is combined with the outer peripheral surface of the fixation body to be able to be rotated, facilitating the seal cap to rise/descend upon the rotation movement;

a brush nozzle inserted into the brush nozzle mounting portion to be fixed, and formed with more than one nozzle inserted into a brush, and an over cap attached to the fixation body so as to be assembled and dissembled.

2. The rotation on/off-type brush-tube-shaped cosmetic container according to claim 1, wherein the screw-type spiral groove comprises:

an inserting groove inserted into the combined protuberance to be combined;

an upper horizontal groove facilitating the combined protuberance to be combined at the maximum rising position, and forming a space of which the perimeter is equal to or less than that of the combined protuberance, so that the combined protuberance is embedded into the space;

a lower horizontal groove facilitating the combined protuberance to be combined at the maximum descending position, and forming a space of which the perimeter is equal to or less than that of the combined protuberance, so that the combined protuberance is embedded into the space;

an inclination groove forming a space having a gap with the combined protuberance, to guarantee not to interfere the movement when the combined protuberance rises/descends; and a bending portion forming a round-shaped curved surface from the upper horizontal groove toward the inclination groove at the position where the combined protuberance starts to descend.

3. The rotation on/off-type brush-tube-shaped cosmetic container according to claim 1, wherein the lower part of the brush nozzle is also formed with a space portion interconnecting with a plurality of nozzles.

4. The rotation on/off-type brush-tube-shaped cosmetic container according to claim 2, wherein the lower part of the brush nozzle is also formed with a space portion interconnection with a plurality of nozzles.

* * * * *